US005719475A

United States Patent [19]

Shishido

[11] Patent Number: 5,719,475

[45] Date of Patent: Feb. 17, 1998

[54] ELECTRON GUN WITH A DYNAMIC DRIVING QUADRUPOLE LENS FOR A COLOR CATHODE RAY TUBE

[75] Inventor: Akira Shishido, Tokyo, Japan

[73] Assignee: NEC Corporation, Tokyo, Japan

[21] Appl. No.: 638,826

[22] Filed: Apr. 29, 1996

[30] Foreign Application Priority Data

Apr. 27, 1995 [JP] Japan ..... 7-103842

[51] Int. Cl.[6] ..... H01J 29/51; H01J 29/46; G09G 1/04

[52] U.S. Cl. ..... 315/368.15; 315/14; 315/381; 313/449

[58] Field of Search ..... 315/368.15, 368.11, 315/381, 3, 14; 313/449

[56] References Cited

U.S. PATENT DOCUMENTS

| | | | |
|---|---|---|---|
| 2,888,606 | 5/1959 | Beam | 315/16 |
| 3,417,199 | 12/1968 | Yoshida et al. | 315/382 |
| 4,760,370 | 7/1988 | Nikaido et al. | 313/449 |
| 4,771,216 | 9/1988 | Blacker et al. | 315/382 |
| 4,786,842 | 11/1988 | Shimoma et al. | 315/3 |

*Primary Examiner*—Gregory C. Issing
*Attorney, Agent, or Firm*—Young & Thompson

[57] ABSTRACT

An electron gun having an improved circuitry for driving the electron gun, which includes a cathode ray tube accommodating at least a cathode, a control electrode, a first acceleration electrode, a convergence electrode comprising first and second grids sandwiching at least a quadrupole lens and a second acceleration electrode. The circuitry is provided with a voltage divider having first and second ends which are electrically connected between the control electrode and the first grid respectively. The voltage divider being electrically connected to at least a dc power supply to apply a bias between the first and second ends of the voltage divider so that the first and second ends of the voltage divider have first and second voltage levels which are different by the bias from each other. The voltage divider has a voltage dividing point between the first and second ends. The voltage dividing point further has a third voltage level which is leveled between the first and second voltage levels which are applied to the control electrode and the first grid respectively. The voltage dividing point is electrically connected to the first the acceleration electrode so that the first acceleration electrode has the third voltage level.

16 Claims, 3 Drawing Sheets

ELECTRON GUN WITH A DYNAMIC DRIVING QUADRUPOLE LENS FOR A COLOR CATHODE RAY TUBE

BACKGROUND OF THE INVENTION

The present invention relates to an electron gun, and more particularly to an electron gun with a dynamic driving quadrupole lens for a color cathode ray tube.

A color cathode ray robe having an in-line electron gun has been known in the art, to which the invention pertains. The color cathode ray tube utilizes a self-convergence system, wherein a deflection yoke is used to generate non-uniformly deflected magnetic fields which comprise a horizontal deflection magnetic field whose magnetic field distribution has a pincushion shape and a vertical deflection magnetic field whose magnetic field distribution has a barrel shape. The non-uniformly deflected magnetic fields may act as a magnetic lens having an astigmatism, which provides electron beams with both a divergence in a horizontal direction and a convergence in a venial direction. For this reason, electron beams shows a long-side way strain. The divergence force in the vertical direction and the convergence force in the horizontal direction are dynamically changed depending upon a deflection position of beam spot on a screen.

In order to settle the above problem, it was proposed to use an electron gun having a dynamic driving quadrupole lens. This is disclosed in the Japanese laid-open patent application No. 2-183946. As illustrated in FIG. 1, the electron gun having the dynamic driving quadrupole lens comprises a cathode 1, a control electrode 20 a first acceleration electrode 3, a first grid 4, a second grid 5 and a second acceleration electrode 6. The first and second grids 4 and 5 form a convergence electrode. Namely, the first grid 4 has three pairs of circular arc burrings 4*a* which face to each other in a horizontal direction. The second grid 5 has three pairs of circular arc burrings 5*a*, both of which face to each other in a vertical direction. The first and second grids 4 and 5 are combined with each other so that the circular arc burrings 4*a* and the circular arc burrings 5*a* are engaged with each other whereby the circular arc burrings 4*a* and the circular arc burrings 5*a* form a quadrupole lens 7 as illustrated in FIG. 2.

The above conventional electron gun is driven as follows. The control electrode 2 is applied with a control voltage Ec1. The first acceleration electrode 3 is applied with a first acceleration voltage Ec2. The first grid 4 of the convergence electrode is applied with a constant focus voltage Ec3. The second grid 5 of the convergence electrode is applied with a dynamic voltage Ec3d which dynamically varies, as illustrated in FIG. 3, depending upon positions on a screen receiving irradiation of electron beam. As a result, the quadrupole lens 7 provides the electron beam with the divergence force in the vertical direction and the convergence force in the horizontal direction as illustrated in FIG. 4. Those vertical divergence and horizontal convergence forces do compensate the long side way strain of the electron beam, wherein the long side way strain is due to the deflected magnetic field caused by the deflection yoke. Namely, the long side way strain of the electron beam, which is caused by the deflected magnetic field generated by the deflection yoke, is canceled by the vertical divergence and horizontal convergence forces provided by the quadrupole lens 7, whereby beam spot free of strain can be obtained.

The above electron gun with the quadrupole lens 7 is, however, engaged with the following disadvantages. As illustrated in FIG. 5, the cathode 1, the control electrode 2, the first acceleration electrode 3, the first grid 4, the second grid 5 and the second acceleration electrode 6 are arranged in turn. In addition, the second acceleration electrode 6 is connected via a resistor 9 to the ground and connected to a dc power supply so that the second acceleration electrode 6 is applied with a high voltage, for example, about 25 kV. The convergence electrode 8 is connected to a desired intermediate point of the resistor to achieve a resistive division of the resistor 9 so that the convergence electrode 8 is applied with a desired voltage generated by the voltage division due to the resistive division. Since, however, the high voltage, for example, about 25 kV is divided by the resistive division, there exists problems in withstand voltage and in reliability of the electron gun device. In order to prevent the problems, an extremely careful operation is required to manufacture the electron gun. Those matters are disclosed in the Japanese laid-open patent application No. 3-67442. Further, in order to drive the dynamic quadrupole lens 7, it is required to apply not only the constant focus electrode Ec3 but also the dynamic voltage Ec3d. This means that it is required to provide not only a power supply for supplying the constant focus electrode Ec3 but also another power supply for supplying the dynamic voltage Ec3d. This further means that it is required to provide an additional voltage supply pin for the additional power supply for driving the dynamic quadrupole lens 7. Namely, the number of the voltage supply pins provided in the conventional electron gun with the dynamic quadrupole lens 7 has to be larger by at least one than the number of the voltage supply pins provided in the standard electron gun free of any dynamic quadrupole lens. The conventional and standard voltage supply pin connection configuration is inapplicable to the conventional dynamic quadrupole lens electron gun. In the above circumstances, it had been required to develop a novel dynamic driving quadrupole lens electron gun having the same number of voltage supply pins as the normal electron gun free of dynamic quadrupole lens.

SUMMARY OF THE INVENTION

Accordingly, it is an object of the present invention to provide an electron gun with dynamic driving quadrupole lens, which is free from the above disadvantages and problems.

It is a further object of the present invention to provide an electron gun with dynamic driving quadrupole lens, which is provided with an improved and simple driving circuit configuration making the electron gun free from the above disadvantages and problems.

It is a furthermore object of the present invention to provide an electron gun with dynamic driving quadrupole lens, which is provided with an improved and simple driving circuit configuration having the same connection configuration for voltage supply pin, as an electron gun free of dynamic driving quadrupole lens.

It is moreover an object of the present invention to provide an electron gun with dynamic driving quadrupole lens, which is provided with an improved and simple driving circuit configuration having the same number of voltage supply pins as an electron gun free of dynamic driving quadrupole lens.

It is still more object of the present invention to provide an electron gun with dynamic driving quadrupole lens, which is provided with an improved and simple driving circuit configuration requiring no extra power supply for driving the dynamic driving quadrupole lens.

It is still a further object of the present invention to provide an electron gun with dynamic driving quadrupole lens, which is provided with an improved and simple driving circuit configuration being compatible to standard interfaces.

The above and other objects, features and advantages of the present invention will be apparent from the following descriptions.

The present invention also provides an electron gun having an improved circuitry for driving the electron gun. The electron gun includes a cathode ray tube which accommodates at least a cathode, a control electrode, a first acceleration electrode, a convergence electrode comprising first and second grids sandwiching at least a quadrupole lens and a second acceleration electrode. The circuitry is provided with a voltage divider having first and second ends which are electrically connected between the control electrode and the first grid respectively. The voltage divider being electrically connected to at least a dc power Supply to apply a bias between the first and second ends of the voltage divider so that the first and second ends of the voltage divider have first and second voltage levels which are different by the bias from each other. The voltage divider has a voltage dividing point between the first and second ends. The voltage dividing point further has a third voltage level which is leveled between the first and second voltage levels which are applied to the control electrode and the first grid respectively. The voltage dividing point is electrically connected to the first the acceleration electrode so that the first acceleration electrode has the third voltage level.

In the above case, it is not necessary to provide any further power supply for exclusively supplying the third voltage level to the first acceleration electrode. This results in a reduction of the manufacturing cost. It is also required to carry out an adjustment process for the reduced number of the power supplies. The voltage divider divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

The present invention also provides an electron gun for a color cathode ray tube with dynamic driving quadrupole lens. The electron gun includes a cathode ray tube having a cathode side and a screen side. The cathode ray tube accommodates a cathode in the cathode side. The cathode ray tube also accommodates a control electrode adjacent to the cathode. The cathode ray tube also accommodates a first acceleration electrode adjacent to the control electrode so that the first acceleration electrode and the cathode sandwich the control electrode. The cathode ray tube also accommodates a convergence electrode adjacent to the first acceleration electrode so that the convergence electrode and the control electrode sandwich the first acceleration electrode. The cathode ray tube also accommodates a second acceleration electrode in the screen side and adjacent to the convergence electrode so that the second acceleration electrode and the first acceleration electrode sandwich the convergence electrode. The convergence electrode comprises a first grid adjacent to the first acceleration electrode and a second grid adjacent to the second acceleration electrode. The first grid of the convergence electrode may have a plurality of pairs of circular arc burrings which face to each other in a horizontal direction. The second grid of the convergence electrode may have a plurality of pairs of circular arc burrings which face to each other in a vertical direction. The first and second grids are combined with each other so that the circular arc burrings of the first and second grids are engaged with each other whereby the circular arc burrings form a quadrupole lens.

The control electrode, the first acceleration electrode and the first grid of the convergence electrode are applied with first, second and third constant voltages different from each other. The second grid of the convergence electrode is applied with a dynamic voltage.

It is important for the present invention to use a power supply and a voltage divider having first and second ends which are electrically connected between the control electrode and the first grid of the convergence electrode respectively. The power supply is electrically connected to the voltage divider so as to apply a bias between the first and second ends of the voltage divider. As a result, the first and second ends of the voltage divider have first and second voltage levels which are different by the bias from each other. The voltage divider also has a voltage dividing point between the first and second ends. The voltage dividing point has a third voltage level which is leveled between the first and second voltage levels which are applied to the control electrode and the first grid of the convergence electrode. The first acceleration electrode is electrically connected to the voltage dividing point of the voltage divider so that the first acceleration electrode has the third voltage level.

In the above case, it is not necessary to provide any further power supply for exclusively supplying the third voltage level to the first acceleration electrode. This results in a reduction of the manufacturing cost. It is also required to carry out an adjustment process for the reduced number of the power supplies. The voltage divider divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

BRIEF DESCRIPTIONS OF THE DRAWINGS

Preferred embodiments of the present invention will be described in detail with reference to the accompanying drawings.

DISCLOSURE OF THE INVENTION

Figure 1:
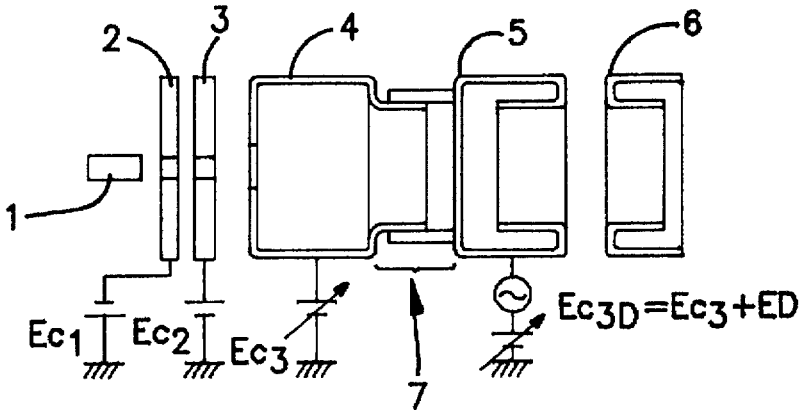
FIG. 1 PRIOR ART
FIG. 1 is a vertical view illustrative of the conventional electron gun with dynamic driving quadrupole lens and a circuit configuration for supplying the power to the electron gun.
Figure 2:
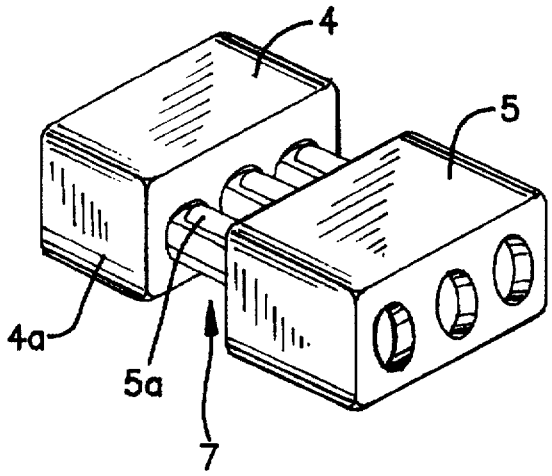
FIG. 2 PRIOR ART
FIG. 2 is a schematic view illustrative of first and second grids included in the conventional electron gun with dynamic driving quadrupole lens.

An electron gun for a color cathode my tube with dynamic driving quadrupole lens is provided. The electron gun includes a cathode ray tube having a cathode side and a screen side. The cathode ray tube accommodates a cathode in the cathode side. The cathode ray tube also accommodates a control electrode adjacent to the cathode. The cathode ray tube also accommodates a first acceleration electrode adjacent to the control electrode so that the first acceleration electrode and the cathode sandwich the control electrode. The cathode ray tube also accommodates a convergence electrode adjacent to the first acceleration electrode so that the convergence electrode and the control electrode sandwich the first acceleration electrode. The cathode ray tube also accommodates a second acceleration electrode in the screen side and adjacent to the convergence electrode so that the second acceleration electrode and the first acceleration electrode sandwich the convergence electrode. The convergence electrode comprises a first grid adjacent to the first acceleration electrode and a second grid adjacent to the second acceleration electrode. The first grid of the convergence electrode may have a plurality of pairs of circular arc burrings which face to each other in a horizontal direction. The second grid of the convergence electrode may have a plurality of pairs of circular arc burrings which face to each other in a vertical direction. The first and second grids are combined with each other so that the circular arc burrings of the first and second grids are engaged with each other whereby the circular arc burrings form a quadrupole lens.

The control electrode, the first acceleration electrode and the first grid of the convergence electrode are applied with first, second and third constant voltages different from each other. The second grid of the convergence electrode is applied with a dynamic voltage.

It is important for the present invention to use a power supply and a voltage divider having first and second ends which are electrically connected between the control electrode and the first grid of the convergence electrode respectively. The power supply is electrically connected to the voltage divider so as to apply a bias between the first and second ends of the divider. As a result, the first and second ends of the voltage divider have first and second voltage levels which are different by the bias from each other. The voltage divider also has a voltage dividing point between the first and second ends. The voltage dividing point has a third voltage level which is leveled between the first and second voltage levels which are applied to the control electrode and the first grid of the convergence electrode. The first acceleration electrode is electrically connected to the voltage dividing point of the voltage divider so that the first acceleration electrode has the third voltage level.

In the above case, it is not necessary to provide any further power supply for exclusively supplying the third voltage level to the first acceleration electrode. This results in a reduction of the manufacturing cost. It is also required to carry out an adjustment process for the reduced number of the power supplies. The voltage divider divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

It may be available that the voltage divider comprises a voltage dividing resistor which is accommodated in the cathode ray tube to improve a withstand voltage and a reliability. This accommodation structure makes it necessary to provide any further pin of stem and makes the cathode ray tube compatible to the standard interface, for example, socket and base pins. The voltage dividing resistor may comprise two resistors in series. The first acceleration electrode is connected to an intermediate between the two resistors.

It may also be available that the first and second ends of the voltage divider are electrically connected to first and second dc power supplies which supply the first and second voltage levels respectively.

It may also be available that the first end of the voltage divider is electrically connected to a first dc power supply which supplies the first voltage level and that the second end of the voltage divider is electrically connected to a ground via a floating capacitor. In this case, no further power supply is required, which supply the second voltage level to the first grid of the convergence electrode. This results in a reduction of the manufacturing cost. It is also required to carry out an adjustment process for the reduced number of the power supplies. Further, the floating capacitor is provided in order to provide a floating capacitance to the first grid of the convergence electrode. The floating capacitance provides a flat and smooth ac-voltage component applied to the second acceleration electrode. This flat and smooth ac-voltage component has a similar voltage waveform to that of dc voltage. The first grid of the convergence electrode is thus applied with the flat and smooth ac-voltage having a similar voltage waveform to that of dc voltage.

It may also be available that the first end of the voltage divider is electrically connected to a first dc power supply which supplies the first voltage level and that a capacitor is electrically connected between the first and second ends of the voltage divider. This results in a reduction of the manufacturing cost. It is also required to carry out an adjustment process for the reduced number of the power supplies. Further, the capacitor is provided in order to provide a floating capacitance between the first grid of the convergence electrode and the other electrode, for example, the control electrode. The floating capacitance provides a flat and smooth ac-voltage component applied to the second acceleration electrode. This flat and smooth ac-voltage component has a similar voltage waveform to that of dc voltage. The first grid of the convergence electrode is thus applied with the flat and smooth ac-voltage having a similar voltage waveform to that of dc voltage.

It may also be available that the first and second grids of the convergence electrode are electrically connected to each other via a resistor so that the first grid of the convergence electrode, the first acceleration electrode and the control electrode are applied with voltages which are different from each other and which are divided and reduced, by the resistor and the voltage divider, from the dynamic driving voltage applied to the second grid of the convergence electrode. The existence of the voltage divider and the resistor makes it necessary to provide only a single power supply for supplying the first, second and third voltage levels different from each other to the control electrode, the first acceleration electrode and the first grid of the convergence electrode. This makes it unnecessary to provide any further pin of stem and makes the cathode ray tube compatible to the standard interface, for example, socket and base pins. Providing the single dc power supply also results in a reduction of the manufacturing cost. It is also required to carry out an adjustment process for the reduced number of the power supplies.

It may also be available that the first grid has a plurality of pairs of first circular arc burrings which face to each other in a horizontal direction, and that the second grid has a plurality of pairs of second circular arc burrings which face to each other in a vertical direction, as well as that the first and second grids are combined with each other so that the first and second circular arc burrings are engaged with each other to form a plurality of quadrupole lenses.

It may also be available that the first grid has a plurality of first openings having a vertical length and a horizontal length which is larger than the vertical length, and that the second grid has a plurality of second openings having a vertical length and a horizontal length which is smaller than the vertical length, as well as that the first and second grids are combined with each other so that the first and second openings face to each other to form a plurality of quadrupole lenses.

It may also be available that the first grid has a plurality of first openings having a vertical length and a horizontal length which is smaller than the vertical length, and that the second grid has a plurality of second openings having a vertical length and a horizontal length which is larger than the vertical length, as well as that the first and second are combined with each other so that the first and second openings face to each other to form a plurality of quadrupole lenses.

The present invention also provides a circuitry being electrically connected to an electron gun for driving the electron gun. The electron gun includes a cathode ray tube which accommodates at least a cathode, a control electrode, a first acceleration electrode, a convergence electrode comprising first and second grids sandwiching at least a quadrupole lens and a second acceleration electrode. The circuitry is provided with a voltage divider having first and second ends which are electrically connected between the control electrode and the first grid respectively. The voltage divider being electrically connected to at least a dc power supply to apply a bias between the first and second ends of the voltage divider so that the first and second ends of the voltage divider have first and second voltage levels which are different by the bias from each other. The voltage divider has a voltage dividing point between the first and second ends. The voltage dividing point further has a third voltage level which is leveled between the first and second voltage levels which are applied to the control electrode and the first grid respectively. The voltage dividing point is electrically connected to the first the acceleration electrode so that the first acceleration electrode has the third voltage level.

In the above case, it is not necessary to provide any further power supply for exclusively supplying the third voltage level to the first acceleration electrode. This results in a reduction of the manufacturing cost. It is also required to carry out an adjustment process for the reduced number of the power supplies. The voltage divider divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

It may be available that the voltage divider comprises a voltage dividing resistor which is accommodated in the cathode ray tube to improve a withstand voltage and a reliability. This accommodation structure makes: unnecessary to provide any further pin of stem and makes the cathode ray tube compatible to the standard interface, for example, socket and base pin. The voltage dividing resistor may comprise two series resisters. The first acceleration electrode is connected to an intermediate between the two resistors.

It may also be available that the first and second ends of the voltage divider are electrically connected to first and second dc power supplies which supply the first and second voltage levels respectively.

It may also be available that the first end of the voltage divider is electrically connected to a first dc power supply which supplies the first voltage level and that the second end of the voltage divider is electrically connected to a ground via a floating capacitor. In this case, no further power supply is required, which supply the second voltage level to the first grid of the convergence electrode. This results in a reduction of the manufacturing cost. It is also required to carry out an adjustment process for the reduced number of the power supplies. Further, the floating capacitor is provided in order to provide a floating capacitance to the first grid of the convergence electrode. The floating capacitance provides a flat and smooth ac-voltage component applied to the second acceleration electrode. This flat and smooth ac-voltage component has a similar voltage waveform to that of dc voltage. The first grid of the convergence electrode is thus applied with the flat and smooth ac-voltage having a similar voltage waveform to that of dc voltage.

It may also be available that the first end of the voltage divider is electrically connected to a first dc power supply which supplies the first voltage level and that a capacitor is electrically connected between the first and second ends of the voltage divider. This results in a reduction of the manufacturing cost. It is also required m carry out an adjustment process for the reduced number of the power supplies. Further, the capacitor is provided in order to provide a floating capacitance between the first grid of the convergence electrode and the other electrode, for example, the control electrode. The floating capacitance provides a flat and smooth ac-voltage component applied to the second acceleration electrode. This flat and smooth ac-voltage component has a similar voltage waveform to that of dc voltage. The first grid of the convergence electrode is thus applied with the flat and smooth ac-voltage having a similar voltage waveform to that of dc voltage.

It may also be available that the first and second grids of the convergence electrode are electrically connected to each other via a resistor so that the first grid of the convergence electrode, the first acceleration electrode and the control electrode are applied with voltages which are different from each other and which are divided and reduced, by the resistor and the voltage divider, from the dynamic driving voltage applied to the second grid of the convergence electrode. The existence of the voltage divider and the resistor makes it necessary to provide only a single power supply for supplying the first, second and third voltage levels different from each other to the control electrode, the first acceleration electrode and the first grid of the convergence electrode. This makes it unnecessary to provide any further pin of stem and makes the cathode ray tube compatible to the standard interface, for example, socket and base pins.

It may also be available that the first grid has a plurality of pairs of first circular arc burrings which face to each other in a horizontal direction, and that the second grid has a plurality of pairs of second circular arc burrings which face to each other m a vertical direction, as well as that the first and second grids are combined with each other so that the first and second circular arc burrings are engaged with each other to form a plurality of quadrupole lenses.

It may also be available that the first grid has a plurality of first openings having a vertical length and a horizontal length which is larger than the vertical length, and that the second grid has a plurality of second openings having a vertical length and a horizontal length which is smaller than the vertical length, as well as that the first and second grids are combined with each other so that the first and second openings face to each other to form a plurality of quadrupole lenses.

It may also be available that the first grid has a plurality of first openings having a vertical length and a horizontal length which is smaller than the vertical length, and that the second grid has a plurality of second openings having a vertical length and a horizontal length which is larger than the vertical length, as well as that the first and second grids are combined with each other so that the first and second openings face to each other to form a plurality of quadrupole lenses.

The above described present inventions may be applicable to any electron guns having quadrupole lens.

Whereas modifications of the present invention will be apparent to a person having ordinary skill in the art, to which the invention pertains, it is to be understood that embodiments to be hereinafter shown and described by way of illustrations are by no means intended to be considered in a limiting sense. Accordingly, it is to be intended to cover by claims all modifications which fall within the spirit and scope of the present invention.

EMBODIMENTS

A first embodiment according to the present invention will be described in detail with reference to FIG, 6. An electron gun for a color cathode ray tube with dynamic driving quadrupole lens is provided. The electron gun includes a cathode ray tube having a cathode side and a screen side. The cathode ray tube accommodates a cathode 11 in the cathode side. The cathode ray robe also accommodates a control electrode 12 which is provided adjacent to the cathode 11. The cathode ray tube also accommodates a first acceleration electrode 13 which is provided adjacent to the control electrode 12 so that the first acceleration electrode 13 and the cathode 11 sandwich the control electrode 12. The cathode ray tube also accommodates a convergence electrode which is provided adjacent to the first acceleration electrode 13 so that the convergence electrode and the control electrode 12 sandwich the first acceleration electrode 13. The cathode ray robe also accommodates a second acceleration electrode 16 in the screen side and adjacent to the convergence electrode so that the second acceleration electrode 16 and the first acceleration electrode 13 sandwich the convergence electrode. The convergence electrode comprises a first grid 14 which is provided adjacent to the first acceleration electrode 13 and a second grid 15 which is provided adjacent to the second acceleration electrode 16. The first grid 14 of the convergence electrode has a plurality of pairs of circular arc burrings which face to each other in a horizontal direction. The second grid of the convergence electrode may have a plurality of pairs of circular arc burrings which face to each other in a vertical direction. The first and second grids 14 and 15 are combined with each other so that the circular arc burrings of the first and second grids are also engaged with each other whereby the circular arc burrings form a plurality of quadrupole lenses 17. The control electrode 12, and the first acceleration electrode 13 the first grid 14 of the convergence electrode are applied with first, second and third constant voltages Ec1, Ec2 and Ec3 respectively. The first, second and third constant voltages Ec1, Ec2 and Ec3 are different from each other. The second grid of the convergence electrode is applied with a dynamic voltage Ec3d=Ec3+Ed.

It is important for the present invention to use power supplies and a voltage divider comprising first and second resisters 18 and 19 in first and second ends respectively. The first and second ends of the voltage divider are connected to the control electrode 12 and the first grid 14 of the convergence electrode respectively. The first and second resistors 18 and 19 are connected in series between the control electrode 12 and the first grid 14 of the convergence electrode. The power supplies are electrically connected to the first and second ends respectively of the voltage divider so as to apply a bias over the voltage divider. As a result, the first and second ends of the voltage divider have first and third voltage levels Ec1 and Ec3 which are different by the bias from each other. The voltage divider also has a voltage dividing point having a voltage level of Ec2. The voltage dividing point of the voltage divider is positioned between the first and second resisters 18 and 19. The voltage dividing point has the second voltage level Ec2 which is leveled between the first and third voltage levels Ec1 and Ec3 which are applied to the control electrode 12 and the first grid 14 of the convergence electrode. The first acceleration electrode 13 is electrically connected to the voltage dividing point of the voltage divider, namely connected to between the first and second resisters 18 and 19 so that the first acceleration electrode 13 has the second voltage level.

Figure 3:
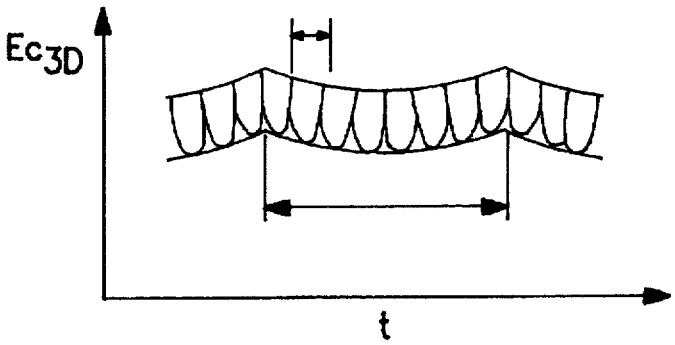
FIG. 3 PRIOR ART
FIG. 3 is a diagram illustrative of a voltage distribution of a dynamic voltage to be applied to a first grid in the conventional electron gun with dynamic driving quadrupole lens.
Figure 4:
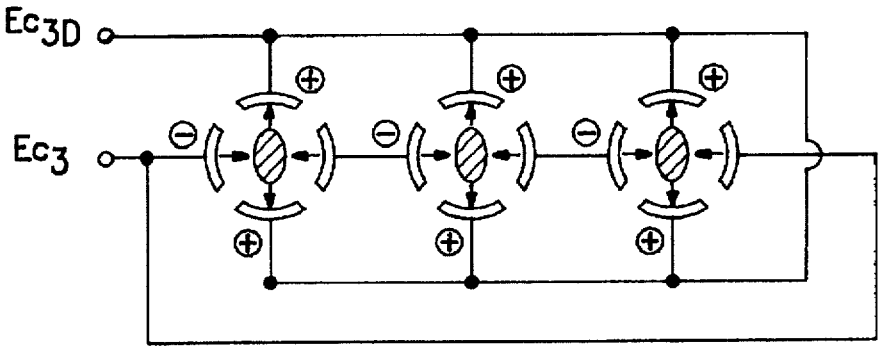
FIG. 4 PRIOR ART
FIG. 4 is a view illustrative of dynamic driving quadrupole lenses in the conventional electron gun and a circuit configuration for supplying powers to the dynamic driving quadrupole lenses.
Figure 5A:
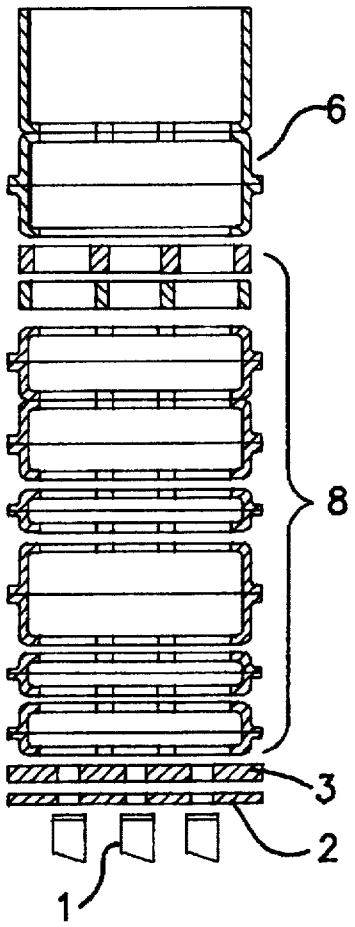
FIG. 5A PRIOR ART
FIG. 5A is a view illustrative of the structure of the conventional electron gun with dynamic driving quadrupole lens.
Figure 5B:
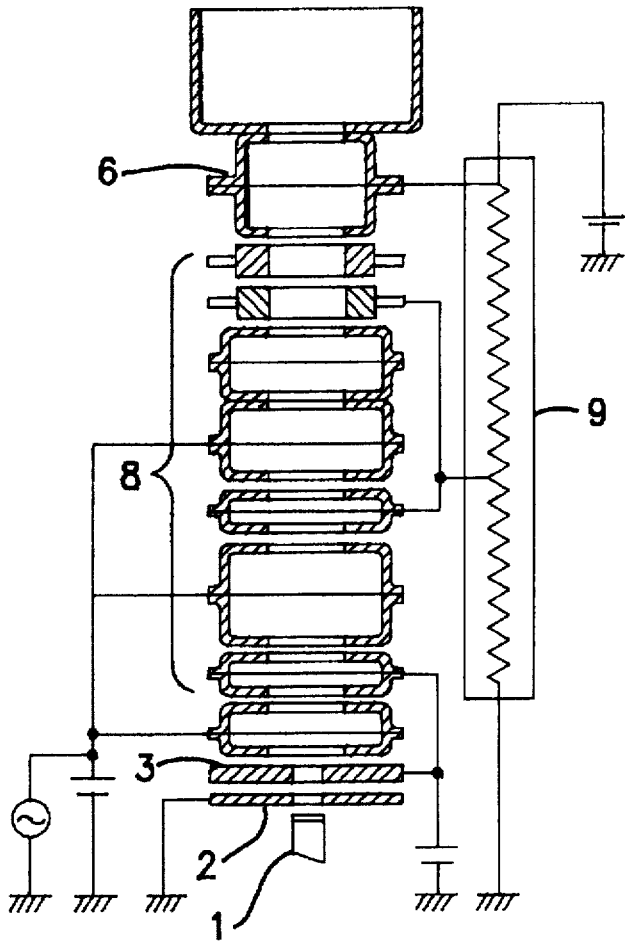
FIG. 5B PRIOR ART
FIG. 5B is a view illustrative of the structure of the conventional electron gun with dynamic driving quadrupole lens and a circuit configuration for supplying power to the electron gun.

The above novel electron gun is driven as follows. The control electrode 12 is applied with the control voltage Ec1. The first acceleration electrode 13 is applied with the acceleration voltage Ec2. The first grid 4 of the convergence voltage is applied with the constant focus electrode Ec3. The second grid 5 of the convergence electrode is applied with the dynamic voltage Ec3d which dynamically varies, as illustrated in FIG. 3, depending upon positions on a screen receiving irradiation of electron beam. As a result, the quadrupole lens 17 provides the electron beam with the divergence force in the vertical direction and the convergence force in the horizontal direction as illustrated in FIG. 4. Those vertical divergence and horizontal convergence forces do compensate the long side way strain of the electron beam, wherein the long side way strain is due to the deflected magnetic field caused by the deflection yoke. Namely, the long side way strain of the electron beam, which is caused by the deflected magnetic field generated by the deflection yoke, is canceled by the vertical divergence and horizontal convergence forces provided by the quadrupole lens 17, whereby a beam spot free of strain can be obtained.

In the above case, it is not necessary to provide any further power supply for exclusively supplying the second voltage level to the first acceleration electrode 13. This results in a reduction of the manufacturing cost. It is also required to carry out an adjustment process for the reduced number of the power supplies. The voltage divider comprising the series resistors 18 and 19 divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

The voltage divider comprising the series resistors 18 and 19 is accommodated in the cathode ray tube to improve a withstand voltage and a reliability. This accommodation structure makes it unnecessary to provide any further pin of stem and makes the cathode ray tube compatible to the standard interface, for example, socket and base pins. The voltage dividing resistor may comprise two series resistors. The first acceleration electrode is connected to an intermediate between the two resistors.

Figure 9:
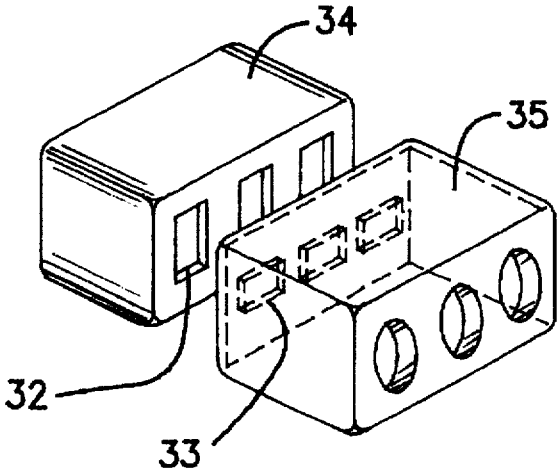
FIG. 9 is a schematic view illustrative of first and second grids which may be included in a novel electron gun with dynamic driving quadrupole lens according to the present invention.
Figure 6:
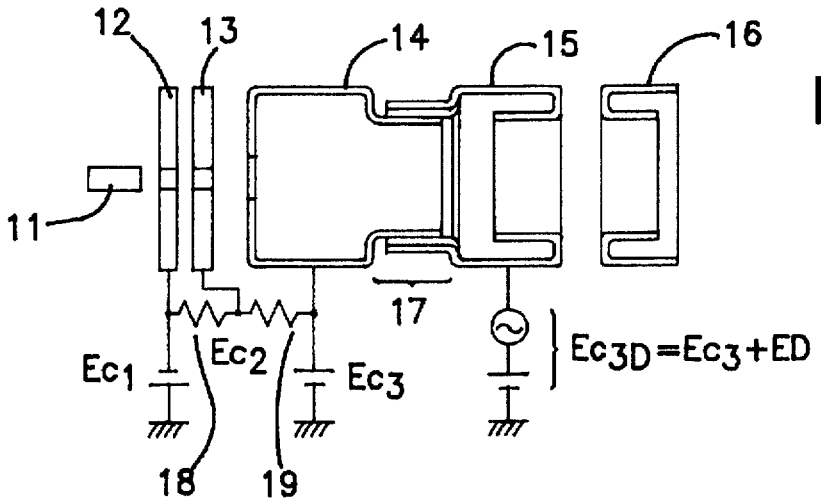
FIG. 6 is a vertical view illustrative of a novel electron gun with dynamic driving quadrupole lens and a circuit configuration for supplying the power to the electron gun in a first embodiment according to the present invention.

As a modification, in place of the above quadrupole lens structure, it is available that as illustrated in FIG. 9 a first grid 34 has a plurality of first openings 32 having a vertical length and a horizontal length which is smaller than the vertical length, and a second grid 35 has a plurality of second openings 33 having a vertical length and a horizontal length which is larger than the vertical length. The first and second grids 34 and 35 are combined with each other so that the first and second openings 32 and 33 face each other to form a plurality of quadrupole lenses.

Figure 7:
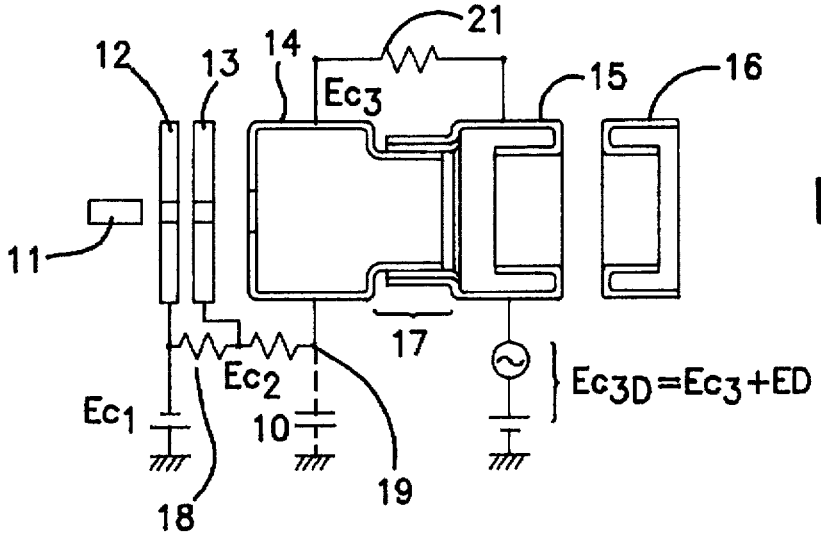
FIG. 7 is a vertical view illustrative of a novel electron gun with dynamic driving quadrupole lens and a circuit configuration for supplying the power to the electron gun in a second embodiment according to the present invention.

A second embodiment according to the present invention will be described in detail with reference to FIG. 7. An electron gun for a color cathode ray tube with dynamic driving quadrupole lens is provided. The electron gun includes a cathode my robe having a cathode side and a screen side. The cathode ray tube accommodates a cathode 11 in the cathode side The cathode ray tube also accommodates a control electrode 12 which is provided adjacent to the cathode 11. The cathode ray tube also accommodates a first acceleration electrode 13 which is provided adjacent to the control electrode 12 so that the first acceleration electrode 13 cathode 11 sandwich the control electrode 12. The cathode ray tube also accommodates a convergence electrode which is provided adjacent to the first acceleration electrode 13 so that the convergence electrode and the control electrode 12 sandwich the first acceleration electrode 13. The cathode ray tube also accommodates a second acceleration electrode 16 in the screen side and adjacent to the convergence electrode so that the second acceleration electrode 16 and the first acceleration electrode 13 sandwich the convergence electrode. The convergence electrode comprises a first grid 14 which is provided adjacent to the first acceleration electrode 13 and a second grid 15 which is provided adjacent to the second acceleration electrode 16. The first grid 14 of the convergence electrode has a plurality of pairs of circular arc burrings which face to each other in a horizontal direction. The second grid of the convergence electrode may have a plurality of pairs of circular arc burrings which face to each other in a vertical direction. The first and second grids 14 and 15 are combined with each other so that the circular arc burrings of the first and second grids are also engaged with each other whereby the circular arc burrings form a plurality of quadrupole lenses 17.

The control electrode 12, and the first acceleration electrode 13 the first grid 14 of the convergence electrode are applied with first, second and third constant voltages respectively. The first, second and third constant voltages are different from each other. The second grid of the convergence electrode is applied with a dynamic voltage Ec3d=Ec3+Ed.

It is important for the present invention to use a single dc power supply and a voltage divider comprising first and second resistors 18 and 19 in first and second ends respectively. The first and second ends of the voltage divider are connected to the control electrode 12 and the first grid 14 of the convergence electrode respectively. The first and second resistors 18 and 19 are connected in series between the control electrode 12 and the first grid 14 of the convergence electrode. The first end of the voltage divide is electrically connected to a single dc power supply which supplies the first voltage level. The second end of the voltage divider is electrically connected to a ground via a floating capacitor 10. A bias is applied over the voltage divider. As a result, the first and second ends of the voltage divider have first and third voltage levels which are different by the bias from each other. The voltage divider also has a voltage dividing point having a voltage level of Ec2. The voltage dividing point of the voltage divider is positioned between the first and second resistors 18 and 19. The voltage dividing point has the second voltage level Ec2 which is leveled between the first and third voltage levels Ec1 and Ec3 which are applied to the control electrode 12 and the first grid 14 of the convergence electrode. The first acceleration electrode 13 is electrically connected to the voltage dividing point of the voltage divider, namely connected to between the first and second resistors 18 and 19 so that the first acceleration electrode 13 has the second voltage level.

In this embodiment, no further power supply is required, which supply the third or second voltage level to the first grid of the convergence electrode or to the first acceleration electrode 13. This results in a reduction of the manufacturing cost. It is also required to carry out an adjustment process for the reduced number of the power supplies. Further, the floating capacitor 10 is provided in order to provide a floating capacitance to the first grid of the convergence electrode. The floating capacitance 10 provides a flat and smooth ac-voltage component applied to the second acceleration electrode 13. This flat and smooth ac-voltage component has a similar voltage waveform to that of dc voltage. The first grid 14 of the convergence electrode is thus applied with the flat and smooth ac-voltage having a similar voltage waveform to that of dc voltage.

The voltage divider comprising the series resistors 18 and 19 divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

The voltage divider comprising the series resistors 18 and 19 is accommodated in the cathode my tube to improve a withstand voltage and a reliability. This accommodation structure makes it unnecessary to provide any further pin of stem and makes the cathode ray tube compatible to the standard interface, for example, socket and base pins. The voltage dividing resistor may comprise two series resistors 18 and 19. The first acceleration electrode 13 is connected to an intermediate between the two resistors 18 and 19.

The first and second grids 14 and 15 of the convergence electrode are electrically connected to each other via a resistor 21 so that the first grid 14 of the convergence electrode, the first acceleration electrode 13 and the control electrode 12 are applied with voltages which are different from each other and which are divided and reduced, by the resistor 21 and the voltage divider, from the dynamic driving voltage applied to the second grid 15 of the convergence electrode. The existence of the voltage divider and the resistor 21 makes it necessary to provide only a single power supply for supplying the first, second and third voltage levels different from each other to the control electrode 12, the first acceleration electrode 13 and the first grid 14 of the convergence electrode. This makes it unnecessary to provide any further pin of stem and makes the cathode ray tube compatible to the standard interface, for example, socket and base pins. Providing the single dc power supply also results in a reduction of the manufacturing cost. It is also required to carry out an adjustment process for the reduced number of the power supplies.

The above novel electron gun is driven as follows. The control electrode 12 is applied with the control voltage Ec1. The first acceleration electrode 13 is applied with the acceleration voltage Ec2. The first grid 4 of the convergence electrode is applied with the constant focus voltage Ec3. The second grid 5 of the convergence electrode is applied with the dynamic voltage Ec3d which dynamically varies, as illustrated in FIG. 3, depending upon positions on a screen receiving irradiation of electron beam. As a result, the quadrupole lens 17 provides the electron beam with the divergence force in the vertical direction and the convergence force in the horizontal direction as illustrated in FIG. 4. Those vertical divergence and horizontal convergence forces do compensate the long side way strain of the electron beam, wherein the long side way strain is due to the deflected magnetic field caused by the deflection yoke. Namely, the long side way strain of the electron beam, which is caused by the deflected magnetic field generated by the deflection yoke, is canceled by the vertical divergence and horizontal convergence forces provided by the quadrupole lens 17, whereby a beam spot free of strain can be obtained.

As a modification, in place of the above quadrupole lens structure, it is available that as illustrated in FIG. 9 a first grid 34 has a plurality of first openings 32 having a vertical length and a horizontal length which is smaller than the vertical length, and a second grid 35 has a plurality of second openings 33 having a vertical length and a horizontal length which is larger than the vertical length. The first and second grids 34 and 35 are combined with each other so that the first and second openings 32 and 33 face each other to form a plurality of quadrupole lenses.

Figure 8:
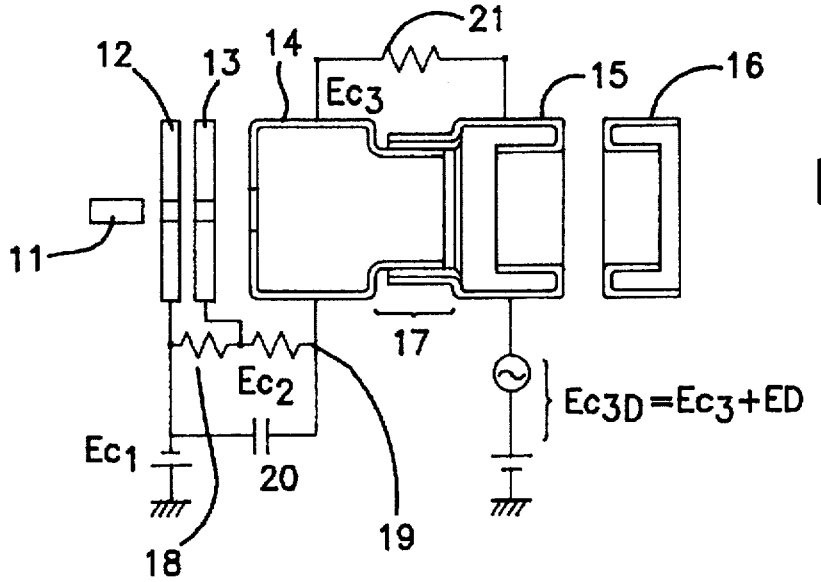
FIG. 8 is a vertical view illustrative of a novel electron gun with dynamic driving quadrupole lens and a circuit configuration for supplying the power to the electron gun in a third embodiment according to the present invention.

A third embodiment according to the present invention will be described in detail with reference to FIG. 8. An electron gun for a color cathode ray tube with dynamic driving quadrupole lens is provided. The electron gun includes a cathode ray tube having a cathode side and a screen side. The cathode ray tube accommodates a cathode 11 in the cathode side. The cathode ray tube also accommodates a control electrode 12 which is provided adjacent to the cathode 11. The cathode my tube also accommodates a first acceleration electrode 13 which is provided adjacent to the control electrode 12 so that the first acceleration electrode 13 and the cathode 11 sandwich the control electrode 12. The cathode ray tube also accommodates a convergence electrode which is provided adjacent to the first acceleration electrode 13 so that the convergence electrode and the control electrode 12 sandwich the first acceleration electrode 13. The cathode ray tube also accommodates a second acceleration electrode 16 in the screen side and adjacent to the convergence electrode so that the second acceleration electrode 16 and the first acceleration electrode 13 sandwich the convergence electrode. The convergence electrode comprises a first grid 14 which is provided adjacent to the lust acceleration electrode 13 and a second grid 15 which is provided adjacent to the second acceleration electrode 16. The first grid 14 of the convergence electrode has a plurality of pairs of circular arc burrings which face to each other in a horizontal direction. The second grid of the convergence electrode may have a plurality of pairs of circular arc burrings which face to each other in a vertical direction. The first and second grids 14 and 15 are combined with each other so that the circular arc burrings of the first and second grids are also engaged with each other whereby the circular arc burrings form a plurality of quadrupole lenses 17.

The control electrode 12, and the first acceleration electrode 13 the first grid 14 of the convergence electrode are applied with first, second and third constant voltages respectively. The first, second and third constant voltages are different from each other. The second grid of the convergence electrode is applied with a dynamic voltage Ec3d=Ec3+Ed.

It is important for the present invention to use a single dc power supply and a voltage divider comprising first and second resistors 18 and 19 in first and second ends respectively. The first and second ends of the voltage divider are connected to the control electrode 12 and the first grid 14 of the convergence electrode respectively. The first and second resistors 18 and 19 are connected in series between the control electrode 12 and the first grid 14 of the convergence electrode. The first end of the voltage divider is electrically connected to a single dc power supply which supplies the first voltage level. A capacitor 20 is electrically connected to between the first and second ends of the voltage divider. A bias is applied over the voltage divider. As a result, the first and second ends of the voltage divider have first and third voltage levels which are different by the bias from each other. The voltage divider also has a voltage dividing point having a voltage level of Ec2. The voltage dividing point of the voltage divider is positioned between the first and second resistors 18 and 19. The voltage dividing point has the second voltage level Ec2 which is leveled between the first and third voltage levels Ec1 and Ec3 which are applied to the control electrode 12 and the first grid 14 of the convergence electrode. The first acceleration electrode 13 is electrically connected to the voltage dividing point of the voltage divider, namely connected to between the first and second resistors 18 and 19 so that the first acceleration electrode 13 has the second voltage level.

In this embodiment, no further power supply is required, which supply the third or second voltage level to the first grid of the convergence electrode or to the first acceleration electrode 13. This results in a reduction of the manufacturing cost. It is also required to carry out an adjustment process for the reduced number of the power supplies.

Further, the capacitor 20 is provided in order to provide a floating capacitance to the first grid of the convergence electrode. This results in a reduction of the manufacturing cost. It is also required to carry out an adjustment process for the reduced number of the power supplies. Further, the capacitor is provided in order to provide a floating capacitance between the first grid of the convergence electrode and the other electrode, for example, the control electrode. The floating capacitance provides a flat and smooth ac-voltage component applied to the second acceleration electrode. This flat and smooth ac-voltage component has a similar voltage waveform to that of dc voltage. The first grid of the convergence electrode is thus applied with the flat and smooth ac-voltage having a similar voltage waveform to that of dc voltage.

The voltage divider comprising the series resistors 18 and 19 divides the high voltage into the low level first, second and third voltages in the range of about 6 kV to about 0 kV to be applied to the control electrode, the first acceleration electrode and the first grid of the convergence electrode. This settles the problems in withstand voltage and a low reliability with the conventional electron gun.

The voltage divider comprising the series resisters 18 and 19 is accommodated in the cathode ray tube to improve a withstand voltage and a reliability. This accommodation structure makes it unnecessary to provide any further pin of stem and makes the cathode ray tube compatible to the standard interface, for example, socket and base pins. The voltage dividing resistor may comprise two series resisters 18 and 19. The first acceleration electrode 13 is connected to an intermediate between the two resisters 18 and 19.

The first and second grids 14 and 15 of the convergence electrode are electrically connected to each other via a resistor 21 so that the first grid 14 of the convergence electrode, the first acceleration electrode 13 and the control electrode 12 arc applied with voltages which are different from each other and which are divided and reduced, by the resistor 21 divider, and the voltage divider, from the dynamic driving voltage applied to the second grid 15 of the convergence electrode. The existence of the voltage divider and the resistor 21 makes it necessary to provide only a single power supply for supplying the first, second and third voltage levels different from each other to the control electrode 12, the first acceleration electrode 13 and the first grid 14 of the convergence electrode. This makes it unnecessary to provide any further pin of stem and makes the cathode ray tube compatible to the standard interface, for example, socket and base pins. Providing the single dc power supply also results m a reduction of the manufacturing cost. It is also required to carry out an adjustment process for the reduced number of the power supplies.

The above novel electron gun is driven as follows. The control electrode 12 is applied with the control voltage Ec1. The first acceleration electrode 13 is applied with the acceleration voltage Ec2. The first grid 4 of the convergence voltage is applied with the constant focus electrode Ec3. The second grid 5 of the convergence electrode is applied with the dynamic voltage Ec3d which dynamically varies, as illustrated in FIG. 3, depending upon positions on a screen receiving irradiation of electron beam. As a result, the quadrupole lens 17 provides the electron beam with the divergence force in the vertical direction and the convergence force in the horizontal direction as illustrated in FIG. 4. Those vertical divergence and horizontal convergence forces do compensate the long side way strain of the electron beam, wherein the long side way strain is due to the deflected magnetic field caused by the deflection yoke. Namely, the long side way strain of the electron beam, which is caused by the deflected magnetic field generated by the deflection yoke, is canceled by the vertical divergence and horizontal convergence forces provided by the quadrupole lens 17, whereby a beam spot free of strain can be obtained.

As a modification, in place of the above quadrupole lens structure, it is available that as illustrated in FIG. 9 a first grid 34 has a plurality of first openings 32 having a vertical length and a horizontal length which is smaller than the vertical length, and a second grid 35 has a plurality of second openings 33 having a vertical length and a horizontal length which is larger than the vertical length. The first and second grids 34 and 35 are combined with each other so that the first and second openings 32 and 33 face each other to form a plurality of quadrupole lenses.

What is claimed is:

1. An electron gun including a cathode ray tube having a cathode side and a screen side, said cathode ray tube comprising:

a cathode in said cathode side;

a control electrode adjacent to said cathode;

a first acceleration electrode adjacent to said control electrode so that said fast acceleration electrode and said cathode sandwich said control electrode;

a convergence electrode adjacent to said first acceleration electrode so that said convergence electrode and said control electrode sandwich said first acceleration electrode, said convergence electrode comprising a first grid adjacent to said first acceleration electrode and a second grid;

a second acceleration electrode adjacent to said second grid, said second acceleration electrode being provided on said screen side and adjacent to said convergence electrode so that said second acceleration electrode and said first acceleration electrode sandwich said convergence electrode; and a voltage divider having first and second ends which are electrically connected between said control electrode and said first grid of said convergence electrode respectively, said voltage divider being electrically connected to at least a power supply to apply a bias between said first and second ends of said voltage divider so that said first and second ends of said voltage divider have first and second voltage levels which are different by said bias from each other, said voltage divider having a voltage dividing point between said first and second ends, said voltage dividing point having a third voltage level between said first and second voltage levels which are applied to said control electrode and said first grid of said convergence electrode respectively, said voltage dividing point being electrically connected to said first acceleration electrode so that said fast acceleration electrode has said third voltage level.

wherein said first and second grids of said convergence electrode are electrically connected to each other via a resistor so that said first, second, and third voltage levels are different from each other and so that a dynamic driving voltage applied to said second grid is divided and reduced into said voltage levels by said resistor and said voltage divider.

2. The electron gun as claimed in claim 1, wherein said voltage divider comprises a voltage dividing resistor which is accommodated in said cathode ray tube.

3. The electron gun as claimed in claim 1, wherein said first and second ends of said voltage divider are electrically connected to first and second dc power supplies which supply said first and second voltage levels respectively.

4. The electron gun as claimed in claim 1, wherein said first end of said voltage divider is electrically connected to a first dc power supply which supplies said first voltage level and wherein said second end of said voltage divider is electrically connected to a ground via a floating capacitor.

5. The electron gun as claimed in claim 1, wherein said first end of said voltage divider is electrically connected to a first dc power supply which supplies said first voltage level and wherein a capacitor is electrically connected between said first and second ends of said voltage divider.

6. The electron gun as claimed in claim 1, wherein said first grid has a plurality of first openings having a vertical length and a horizontal length which is smaller than said vertical length, wherein said second grid has a plurality of second opening having a vertical length and a horizontal length which is larger than said vertical length, and wherein said first and second grids are combined with each other so that said first and second openings face to each other to form a plurality of quadrupole lenses.

7. The electron gun as claimed in claim 1, wherein said first grid has a plurality of pairs of first circular arc burrings which face to each other in a horizontal direction, wherein said second grid has a plurality of pairs of second circular arc burrings which face to each other in a vertical direction, and wherein said first and second grids are combined with each other so that said first and second circular arc burrings are engaged with each other to form a plurality of quadrupole lenses.

8. The electron gun as claimed in claim 1, wherein said first grid has a plurality of first openings having a vertical length and a horizontal length which is larger than said vertical length, wherein said second grid has a plurality of second openings having a vertical length and a horizontal length which is smaller than said vertical length, and wherein said first and second grids are combined with each other so that said first and second openings face to each other to form a plurality of quadrupole lenses.

9. A circuit electrically connected to an electron gun for driving said electron gun, said electron gun accommodating at least a cathode, a control electrode, a first acceleration electrode, a convergence electrode comprising first and second grids sandwiching at least a quadrupole lens and a second acceleration electrode, said circuit comprising: a voltage divider having first and second ends which are electrically connected between said control electrode and said first grid respectively, said voltage divider being electrically connected to at least a dc power supply to apply a bias between said first and second ends of said voltage divider so that said first and second ends of said voltage divider have first and second voltage levels which are different by said bias from each other, said voltage divider having a voltage dividing point between said first and second ends, said voltage dividing point having a third voltage level which is leveled between said first and second voltage levels which are applied to said control electrode and said first grid respectively, said voltage dividing point being electrically connected to said first acceleration electrode so that said first acceleration electrode has said third voltage level, wherein said first and second grids of said convergence electrode are electrically connected to each other via a resistor so that said first, second, and third voltage levels are different from each other and so that a dynamic driving voltage applied to said second grid is divided and reduced into said voltage levels by said resistor and said voltage divider.

10. The circuit as claimed in claim 9, wherein said voltage divider comprises a voltage dividing resistor which is accommodated inside cathode ray tube.

11. The circuit as claimed in claim 9, whereto said first and second ends of said voltage divider are electrically connected to first and second dc power supplies which supply said first and second voltage levels respectively.

12. The circuit as claimed in claim 9, wherein said first end of said voltage divider is electrically connected to a first dc power supply which supplies said first voltage level and wherein said second end of said voltage divider is electrically connected to a ground via a floating capacitor.

13. The circuit as claimed in claim 9, wherein said first end of said voltage divider is electrically connected to a first dc power supply which supplies said first voltage level and wherein a capacitor is electrically connected between said first and second ends of said voltage divider.

14. The circuit as claimed in claim 9, wherein said first grid has a plurality of pairs of first circular arc burrings which face to each other in a horizontal direction, wherein said second grid has a plurality of pairs of second circular arc burrings which face to each other in a vertical direction, and wherein said first and second grids are combined with each other so that said first and second circular arc burrings are engaged with each other to form a plurality of quadrupole lenses.

15. The circuit as claimed in claim 9, whereto said first grid has a plurality of first openings having a vertical length and a horizontal length which is larger than said vertical length, wherein said second grid has a plurality of second openings having a vertical length and a horizontal length which is smaller than said vertical length, and wherein said first and second grids are combined with each other so that said first and second openings face to each other to form a plurality of quadrupole lenses.

16. The circuit as claimed in claim 9, wherein said first grid has a plurality of first openings having a vertical length and a horizontal length which is smaller than said vertical length, wherein said second grid has a plurality of second openings having a vertical length and a horizontal length which is larger than said vertical length, and wherein said first and second grids are combined with each other so that said first and second openings face to each other to form a plurality of quadrupole lenses.

* * * * *